US012630928B2

(12) United States Patent
Cotinot

(10) Patent No.: US 12,630,928 B2
(45) Date of Patent: May 19, 2026

(54) COMPOSITION, ITS USE FOR ACID PICKLING OF MAGNESIUM ALLOYS AND METHOD FOR ACID PICKLING OF MAGNESIUM ALLOYS

(71) Applicant: SAFRAN AIRCRAFT ENGINES, Paris (FR)

(72) Inventor: Jeremie Christian Andre Cotinot, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 739 days.

(21) Appl. No.: 17/626,298

(22) PCT Filed: Jul. 7, 2020

(86) PCT No.: PCT/FR2020/051206

§ 371 (c)(1),
(2) Date: Jan. 11, 2022

(87) PCT Pub. No.: WO2021/009437

PCT Pub. Date: Jan. 21, 2021

(65) Prior Publication Data

US 2022/0267907 A1 Aug. 25, 2022

(30) Foreign Application Priority Data

Jul. 15, 2019 (FR) ..... 1907921

(51) Int. Cl.
*C23C 22/18* (2006.01)
*C23C 22/73* (2006.01)
(Continued)

(52) U.S. Cl.
CPC ..... *C23C 22/18* (2013.01); *C23C 22/73* (2013.01); *C23F 1/22* (2013.01); *C23G 1/12* (2013.01)

(58) Field of Classification Search
CPC ..... C23C 22/18; C23C 22/73; C23F 1/22; C23G 1/12
See application file for complete search history.

(56) References Cited

U.S. PATENT DOCUMENTS 6,787,192 B2 * 9/2004 Fukumura ..... C23C 28/00 427/337
2002/0174915 A1 * 11/2002 Futsuhara ..... C23C 22/18 148/254
2012/0171502 A1 * 7/2012 Chang ..... C23C 22/57 204/192.12

FOREIGN PATENT DOCUMENTS

CN 103898585 A 7/2014
JP 2003-277944 A 10/2003

OTHER PUBLICATIONS

International Search Report received for PCT Patent Application No. PCT/FR2020/051206, mailed on Oct. 22, 2020, 6 pages (2 pages of English Translation and 4 pages of Original Document).
(Continued)

*Primary Examiner* — Adil A. Siddiqui
(74) *Attorney, Agent, or Firm* — WOMBLE BOND DICKINSON (US) LLP

(57) ABSTRACT

Composition, characterized in that: —it comprises, in a solution of demineralized water: between 10 and 80, preferably between 15 and 20, more preferably 17, g/l of a composition of phosphoric acid $H_3PO_4$, and between 2 and 15, preferably between 4 and 8, more preferably 6, g/l of a composition of potassium permanganate $KMnO_4$, —the weight ratio $H_3PO_4/KMnO_4$ is between 1.5 and 10, preferably between 1.8 and 5, mote preferably equal to 2.8, —said composition has a pH between 2.4 and 3, preferably 2.5.

10 Claims, 1 Drawing Sheet

(51) Int. Cl.
*C23F 1/22* (2006.01)
*C23G 1/12* (2006.01)

(56) References Cited

OTHER PUBLICATIONS

Lei et al., "Successful cyanide free plating protocols on magnesium alloys", Transactions of the Institute of Metal Finishing, vol. 88, No. 2, Mar. 1, 2010, pp. 75-80.

* cited by examiner

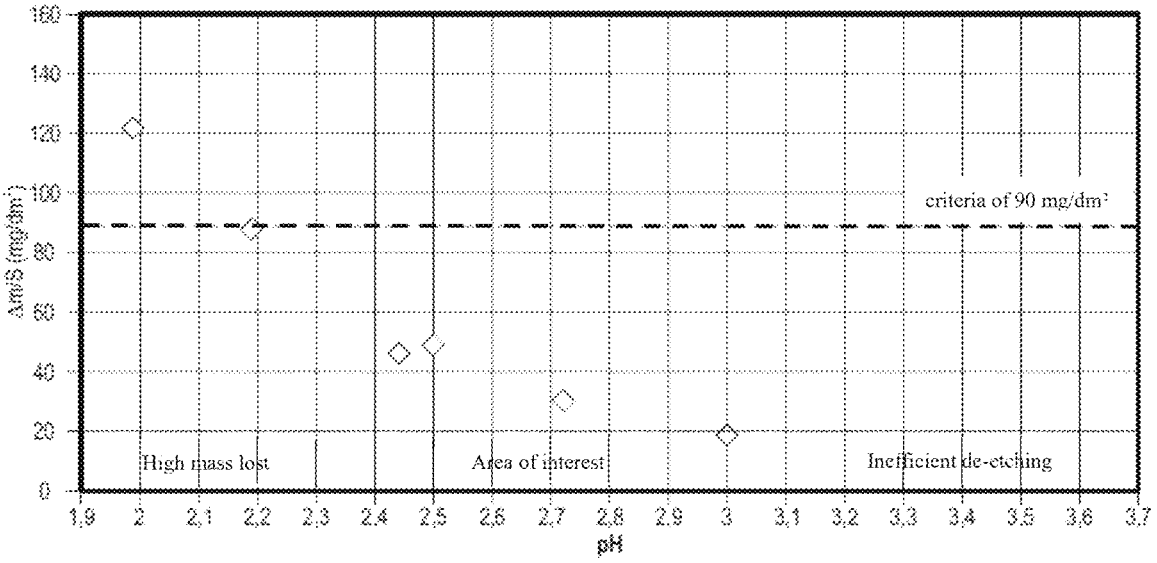
ΔmS (mg/dm²)
pH
criteria of 90 mg/dm²
High mass lost
Area of interest
Inefficient de-etching
0
20
40
60
80
100
120
140
160
1,9
2
2,1
2,2
2,3
2,4
2,5
2,6
2,7
2,8
2,9
3
3,1
3,2
3,3
3,4
3,5
3,6
3,7

COMPOSITION, ITS USE FOR ACID PICKLING OF MAGNESIUM ALLOYS AND METHOD FOR ACID PICKLING OF MAGNESIUM ALLOYS

TECHNICAL FIELD OF THE INVENTION

The invention relates to a composition, its use for de-etching magnesium alloys, and a method for de-etching magnesium alloys.

BACKGROUND

Many devices used in aeronautics, such as turboprop engines, comprise parts made of a magnesium alloy, and more particularly of a magnesium alloy containing silver.

The repair (reconditioning) of these parts made of magnesium alloy containing silver involves a step consisting in removing/pickling the initial chemical conversion coating present on these parts in a bath referred to as a "de-etching" bath, the etching being the step of creating this chemical conversion coating on the magnesium alloy parts.

The de-etching bath is also used for the new production in the case of a defect on the part during its initial etching: the defect is removed (de-etching) and the coating is renewed (re-etching).

In some of the currently used de-etching baths, chromic acid ($H_2CrO_4$, CAS #7738-94-5) and optionally barium chromate ($BaCrO_4$, CAS #10294-40-3) are present.

However, the European regulation REACh will soon prohibit the use of these two substances in particular, which are also implemented in a large number of surface treatment methods.

To replace this soon-to-be-banned de-etching bath, various baths have already been proposed, such as a bath containing hydrofluoric acid (HF), nitric acid ($NHO_3$) and hexafluorozirconic acid ($H_2ZrF_6$).

However, this bath does not allow for pickling magnesium alloys containing silver as an alloying element. Indeed, due to the presence of nitric acid, the silver contained in the alloy is dissolved in the bath and is redeposited during the treatment on the part, forming a deposit of black colour (silver nitrate), thus preventing any subsequent surface treatment operation. In other words, this chemistry is not suitable for the treatment of some specific alloys currently implemented.

A second technical reason prevents the use of this bath on mature military equipment.

Indeed, this bath has a high dissolution rate of the treated alloy, and therefore slightly reduces the dimensions of the treated parts (significant variation for a standard treatment time). This reduction in dimensions (or dimension downgrade) is not acceptable for the division of the mature military engines, for which the preservation of the dimensions of the treated parts is imperative in order to limit scrap requiring the resupply of old parts, generating significant costs.

In this context, the invention aims to provide a composition for de-etching bath which allows to:

- not to use substances impacted by REACh (no hexavalent chromium);
- not to reduce the size of the treated material (<5 μm);

- allow the removal of the chemical conversion layers of a few microns on the silver-containing magnesium alloys (e.g. MSR-B grade) as well as the other grades, possibly after a light manual rubbing with an abrasive pad (the part is rubbed with a lightly abrasive Brite® tape to remove the coating residues)
- leave the surface in a state adapted to retreat (no powdering, homogeneous removing, etc.).

SUMMARY OF THE INVENTION

To this end, the invention provides a composition, characterised in that:

it comprises, in a solution of water:

- between 10 and 80 g/l of a composition of phosphoric acid $H_3PO_4$, and
- between 2 and 15 g/l of a composition of potassium permanganate $KMnO_4$,
- the weight ratio $H_3PO_4/KMnO_4$ is between 1.5 and 10, preferably between 1.8 and 5, most preferably equal to 2.8,
- said composition has a pH between 2.4 and 3, preferably 2.5.

In an embodiment of the invention, the composition comprises:

- between 10 and 30 g/l, preferably between 15 and 20 g/l of a composition of phosphoric acid $H_3PO_4$, and
- between 4 and 8 g/l of a composition of potassium permanganate $KMnO_4$.

This composition may comprise:

- 17 g/l of a composition of phosphoric acid $H_3PO_4$, and
- 6 g/l of a composition of potassium permanganate $KMnO_4$,
- said composition having a pH of 2.5.

In another embodiment of the invention, the composition comprises:

- between 20 and 80 g/l of a composition of phosphoric acid $H_3PO_4$, and
- the weight ratio $H_3PO_4/KMnO_4$ is between 2.5 and 10, preferably between 2.5 and 5, most preferably equal to 2.8.

The composition of the invention may further comprise an agent for adjusting the pH different from nitric acid $HNO_3$, preferably selected from acetic acid $CH_3COOH$, sulfuric acid $H_2SO_4$, phosphoric acid $H_3PO_4$, sodium hydroxide NaOH and potassium hydroxide KOH.

The invention also proposes a use of the composition according to the invention for the de-etching of a part made of a magnesium alloy, in particular containing silver.

The invention also proposes a method for de-etching a part made of a magnesium alloy, characterised in that it comprises a step a) of immersing said part in a bath comprising the composition according to the invention.

Preferably, this step a) is implemented at a temperature of between 10 and 35° C., preferably between 15 and 35° C., for 5 to 20 minutes, preferably for 10 minutes.

Still preferably, the method of the invention further comprises, prior to the step a), a step a1) of adjusting the pH of the bath to a pH between 2.4 and 3, preferably to a pH of 2.5.

In this case, the step a1) is preferably implemented:

- either by adding an acid other than nitric acid, preferably by adding an acid selected from acetic acid, sulfuric acid and phosphoric acid, to reduce the pH,
- or by adding sodium hydroxide and/or potassium hydroxide, preferably potassium hydroxide, to increase the pH.

It is a characteristic of the method of the invention that said part is made of a magnesium alloy containing silver.

BRIEF DESCRIPTION OF FIGURES

The invention will be better understood, and other advantages and characteristics of the invention will become clearer upon reading the following explanatory description, which is made with reference to the attached FIG. 1.

FIG. 1 shows the variation of the mass loss of a magnesium alloy of grade MSR-B T6 comprising 2 to 3% silver, 2 to 3% rare earth and 0 to 4% zirconium immersed for 8 minutes in a bath (a composition) according to the invention, at 25° C., as a function of the pH;

DETAILED DESCRIPTION OF THE INVENTION

The composition of the invention allows to dissolve the layer to be removed on a magnesium alloy part, such as a rare earth magnesium alloy (e.g. grades WE43, E121), a magnesium-aluminium alloy (e.g. grade AZ91), a magnesium-zinc alloy (e.g. grade ZRE1) and above all a magnesium alloy containing silver, without attacking the magnesium, i.e. without any significant loss of mass.

It comprises an acid allowing to pickle the magnesium alloy on the surface.

Due to European regulations REACh, the acid cannot be the chromic acid currently used and the use of which will be in the near future.

However, chromic acid has been used for decades because it allowed to guarantee a negligible reduction in the geometric dimensions of the treated parts, as it limits the dissolution of the surface layer: the chromic acid allows the formation of a film of $Cr_2O_3$ and $Cr(OH)_3$. The chromic acid acted as both an inhibitor and an acid.

The acids used in the field of the pickling of the magnesium alloy are hydrofluoric, nitric, sulfuric and acetic acids.

However, these acids lead to excessively high dissolution rates of the surface layer, i.e. to an unacceptable reduction in the geometric dimensions of the treated parts.

To overcome this disadvantage, the invention proposes to use, in combination with the acid (different from chromic acid), a second component whose purpose is not to reduce the rate of dissolution of the acid but to protect the surface exposed by the acid.

This second component is an inhibitor that acts by forming a thin layer of protection.

This thin layer of protection should then be removed by simply rinsing with distilled water.

As such an inhibitor, the inventors have tested the cerium nitrate $Ce(NO_3)_3$ which forms a cerium oxide layer and potassium permanganate $KMnO_4$ which forms a manganese oxide layer.

However, here again, the dissolution rates of the surface layer are too high, leading to an unacceptable reduction in the geometric dimensions of the treated parts.

The inventors then discovered that a composition comprising defined amounts of phosphoric acid and potassium permanganate, in precise proportions and in defined weight ratios (concentration ratio), and at a defined pH, could be used for de-etching magnesium alloy parts of all grades, comprising those containing silver.

The two species phosphoric acid and potassium permanganate are not species commonly used by the person skilled in the art of the surface treatment and have never been used before, to the knowledge of the inventors, for the specific operation of de-etching magnesium alloys.

Thus, the inventors have discovered that a composition comprising in a solution of water of between 10 and 80 g/l of composition, of phosphoric acid $H_3PO_4$, and between 2 and 15 g/l of composition, of potassium permanganate $KMnO_4$, at a weight ratio $H_3PO_4/KMnO_4$ comprised between 1.5 and 10, preferably between 1.8 and 10, or even between 1.8 and 5 or between 2.5 and 5, most preferably equal to 2.8, said composition having a pH of between 2.4 and 3, could be used for the de-etching of magnesium alloy parts of all grades, comprising those containing silver.

Below the low limits indicated above, the respective actions of phosphoric acid pickling and potassium permanganate protection of the exposed surface of the part are not sufficient.

Using values above the high limits indicated above will not allow to provide any additional effect.

A preferred composition comprises between 10 and 30 g or 15 and 20 g per litre of composition of phosphoric acid and between 2 and 15 g or 4 and 8 g per litre of composition of potassium permanganate.

The most preferred composition comprises 17 g per litre of composition of phosphoric acid and 6 g per litre of composition of potassium permanganate $KMnO_4$.

Another preferred composition comprises between 20 and 80 g per litre of composition of phosphoric acid, and between 2 and 15 g per litre of composition of potassium permanganate. The weight ratio $H_3PO_4/KMnO_4$ is between 2.5 and 10, preferably between 2.5 and 5, most preferably equal to 2.8.

The weight ratio $H_3PO_4/KMnO_4$ is preferably 2.8

The composition preferably has a pH of between 2.4 and 3.0. Most preferably the composition of the invention has a pH of 2.5.

To achieve the desired pH, the composition of the invention may further contain an adjusting agent of the pH.

When the pH needs to be lowered, such an agent can be an acid.

However, of course, chromic acid cannot be used.

Nitric acid cannot be used either, as otherwise silver nitrate will form on the surface of the part and the surface treatment cannot continue.

Preferred acids are acetic acid $CH_3COOH$, sulfuric acid $H_2SO_4$, phosphoric acid ($H_3PO_4$) and mixtures thereof.

When the pH needs to be increased, such an agent can be a base.

Preferred bases are sodium hydroxide NaOH and potassium hydroxide KOH.

Potassium hydroxide is particularly preferred because it has the same spectator ion as the $KMnO_4$, which limits the interactions between ions.

The invention also provides a method for de-etching magnesium alloys, comprising those containing silver.

The method for de-etching a part made of a magnesium alloy of the invention comprises a step a) of immersing said part in a bath comprising the composition according to the invention.

The bath used during the implementation of the method of the invention may contain, in addition to the composition of the invention, other agents such as, for example, other magnesium inhibitors, i.e. other chemical species capable of forming precipitates on the surface of the part in order to form a thin film stopping the attack of the acid. Examples include cerium nitrate or $H_2ZrF_6$.

For optimum effect, the step a) is implemented at a temperature of between 10 and 35° C., preferably between 15 and 35° C., for 5 to 20 minutes, preferably for 10 minutes. It is preferable to keep the bath stirred during the step a).

In order to carry out the step a) at the correct pH, it may be necessary to implement, before the step a), a step a1) of adjusting the pH of the bath to a pH between 2.4 and 3, preferably 2.5.

In this case, the step a1) is implemented:

- either by adding an acid other than nitric acid, preferably by adding an acid selected from acetic acid, sulfuric acid and phosphoric acid, to reduce the pH,
- or by adding sodium hydroxide and/or potassium hydroxide, preferably potassium hydroxide, to increase the pH.

Before carrying out the step a), it is preferable to check that the loss of mass of the parts to be treated obtained by immersion in the bath in the step a) at the planned pH, temperature and time, is well below or equal to the tolerated loss of mass.

This mass loss, for application to the division of the mature military engine, shall be less than 90 g/dm$^2$, preferably less than or equal to 85 g/dm$^2$.

For this purpose, a test step a2) is implemented before the step a) and after the step a1).

This step a2) consists of immersing a follow-up specimen, made of the same magnesium alloy as that of the part to be treated and with a known surface, in the bath of the step a), for the time and at the temperature that will be applied to the part to be treated itself. The specimen is then weighed and checked for a loss of mass of less than 90 mg/dm$^2$, preferably less than or equal to 85 gd/m$^2$.

The method of the invention then comprises, preferably two successive steps b1) of rinsing the parts obtained after the step a) and b2).

These steps b1) and b2) are implemented in water, preferably demineralised, for at least 1 minute.

Finally, the method of the invention comprises a step c) of cleaning the treated parts.

This step c) consists of removing, by any method apparent to the person skilled in the art, the manganese oxide layer formed on the surface of the treated part. This layer is usually a few microns thick and has a darker colour than the untreated part. Thus, a rubbing of the surface of the part with an abrasive pad until the dark layer disappears is sufficient to remove it.

In order to better understand the invention, several implementation modes will now be described in the following examples.

EXAMPLES

Example 1

6 specimens having a surface area of 0.5 dm$^2$ were cut from a magnesium alloy containing silver of grade MSR-B

Example 2

6 de-etching baths were prepared containing 17 g/l phosphoric acid, 6 g/l potassium permanganate, the remainder being water.

The first bath, noted B1, was adjusted to a pH of 1.99.

The second bath, noted B2, was adjusted to a pH of 2.18.

The third bath, noted B3, was adjusted to a pH of 2.44.

The fourth bath, noted B4, was adjusted to a pH of 2.5.

The fifth bath, noted B5, was adjusted to a pH of 2.72.

The sixth bath, noted B6, was adjusted to a pH of 3.0.

Example 3

The 6 specimens prepared in Example 1 were each immersed respectively in one of the baths B1 to B6 for 8 minutes at a temperature of 25° C. A stirring was maintained in the bath by means of a propeller placed in the bath.

After 8 minutes, the specimens are taken out of the baths and rinsed by soaking them twice in a water bath for 1 minute.

They are then dried and the black manganese oxide layer formed on their surface is removed with an abrasive pad.

They are then weighed and their mass losses in mg/dm$^2$ are measured.

FIG. 1 shows the results obtained in terms of mass loss as a function of the pH of the bath.

As shown in FIG. 1, when the pH of the bath is below 2.3, the mass losses are too high: they are greater than or equal to 90 mg/dm$^2$.

It can also be seen that the higher the pH of the bath, the lower the mass losses.

However, above pH 3, it is increasingly difficult to pickle (remove the manganese oxide layer) the parts.

The pH of the de-etching bath of the invention must therefore be maintained between 2.4 and 3.

Most preferably, the pH is 2.5.

The invention claimed is:

1. A de-etching composition for the de-etching of a part made of a magnesium alloy containing silver, wherein:

said composition comprises, in a solution of water:

between 10 and 80 g/l of a composition of phosphoric acid $H_3PO_4$, and between 2 and 15 g/l of a composition of potassium permanganate $KMnO_4$, the weight ratio $H_3PO_4/KMnO_4$ is between 1.5 and 10, said composition comprising cerium nitrate;

wherein said composition further comprises an agent for adjusting the pH different from nitric acid $HNO_3$, selected from acetic acid $CH_3COOH$, sulfuric acid $H_2SO_4$, phosphoric acid $H_3PO_4$, sodium hydroxide NaOH and potassium hydroxide KOH so that said composition has a pH between 2.4 and 3.

2. The composition according to claim 1, wherein:

said composition comprises:

between 10 and 30 g/l, of a composition of phosphoric acid $H_3PO_4$, and between 4 and 8 g/l of a composition of potassium permanganate $KMnO_4$.

3. The composition according to claim 1, wherein said composition comprises:

17 g/l of a composition of phosphoric acid $H_3PO_4$, and 6 g/l of a composition of potassium permanganate $KMnO_4$, said composition has a pH of 2.5.

4. The composition according to claim 1, wherein:

said composition comprises:

between 20 and 80 g/l of a composition of phosphoric acid $H_3PO_4$, and the weight ratio $H_3PO_4/KMnO_4$ is between 2.5 and 10.

5. Use of the composition according to claim 1 for the de-etching of a part made of a magnesium alloy containing silver.

6. A method for de-etching a part made of a magnesium alloy, wherein the method comprises a step a) of immersing said part in a bath comprising the composition according to claim 1.

7. The method according to claim 6, wherein the step a) is implemented at a temperature of between 1° and 35° C., for 5 to 20 min.

8. The method according to claim 6, wherein the method further comprises, prior to the step a), a step a1) of adjusting the pH of the bath to a pH between 12.4 and 3.

9. The method according to claim 8, wherein the step a1) is implemented:

either by adding an acid other than nitric acid, by adding an acid selected from acetic acid, sulfuric acid and phosphoric acid, to reduce the pH, or by adding sodium hydroxide and/or potassium hydroxide to increase the pH.

10. A de-etching composition for the de-etching of a part made of a magnesium alloy containing silver, wherein:

said composition comprises, in a solution of water:

between 10 and 80 g/l of a composition of phosphoric acid $H_3PO_4$, and between 2 and 15 g/l of a composition of potassium permanganate $KMnO_4$, the weight ratio $H_3PO_4/KMnO_4$ is between 1.5 and 10, said composition comprising cerium nitrate;

wherein said composition further comprises an agent for adjusting the pH different from nitric acid $HNO_3$, selected from acetic acid $CH_3COOH$, sodium hydroxide NaOH and potassium hydroxide KOH so that said composition has a pH between 2.4 and 3.

* * * * *